US006454011B1

(12) United States Patent
Schempf et al.

(10) Patent No.: US 6,454,011 B1
(45) Date of Patent: Sep. 24, 2002

(54) METHOD AND SYSTEM FOR MOVING EQUIPMENT INTO AND THROUGH A CONDUIT

(75) Inventors: Hagen Schempf, Pittsburgh, PA (US); Steve J. Kimminau, Rijswijk (NL); Hans J. J. den Boer, Rijswijk (NL); John F. Stewart, Rijswijk (NL); A. F. Bijleveld, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/329,611

(22) Filed: Jun. 10, 1999

Related U.S. Application Data

(60) Provisional application No. 60/089,032, filed on Jun. 12, 1998.

(51) Int. Cl.[7] ..... E21B 33/068; E21B 33/076

(52) U.S. Cl. ..... 166/381; 166/70; 166/75.15; 166/66.4; 166/335

(58) Field of Search ..... 166/70, 75.15, 166/383, 381, 335, 66.4

(56) References Cited

U.S. PATENT DOCUMENTS

| | | | | | |
|---|---|---|---|---|---|
| 2,713,909 | A | * | 7/1955 | Baker | 166/70 |
| 3,396,789 | A | * | 8/1968 | Dean | 166/351 |
| 4,418,756 | A | * | 12/1983 | Yonker et al. | 166/383 |
| 4,616,706 | A | * | 10/1986 | Huffaker et al. | 166/341 |
| 5,184,676 | A | * | 2/1993 | Graham et al. | 166/66.4 |
| 5,188,178 | A | * | 2/1993 | Noyes | 166/310 |
| 6,039,122 | A | * | 3/2000 | Gonzalez | 166/379 |
| 6,189,621 | B1 | * | 2/2001 | Vail, III | 166/385 |

FOREIGN PATENT DOCUMENTS

| | | |
|---|---|---|
| WO | WO 90/02864 | 3/1990 |
| WO | WO 91/16520 | 10/1991 |
| WO | WO 93/18277 | 9/1993 |
| WO | WO 95/21987 | 8/1995 |
| WO | WO 98/12418 | 3/1998 |

* cited by examiner

*Primary Examiner*—Hoang Dang

(57) ABSTRACT

A method and system are disclosed for moving equipment into and through a conduit that is preferably an oil and/or gas production well, wherein use is made of an uphole equipment storage and handling unit via which equipment modules can be moved into a launch conduit and connected to a shuttle device which is able to locomote itself as a wireless tractor via the launch conduit into and from the underlying conduit.

11 Claims, 5 Drawing Sheets

METHOD AND SYSTEM FOR MOVING EQUIPMENT INTO AND THROUGH A CONDUIT

This application claims benefit of U.S. Provisional Application No. 60/089,032 filed on Jun. 12, 1998.

FIELD OF THE INVENTION

The invention relates to a method and system for transporting equipment through a conduit, such as an underground well.

BACKGROUND TO THE INVENTION

In underground oil and/or gas production wells transportation of equipment generally requires complex procedures and transportation systems. Currently available systems include slick-wireline systems, coiled tubing, electric downhole tractors and through flow line (TFL) systems. TFL systems employ TFL pistons that are pumped up and down through a production tubing, which requires the installation of parallel production tubings which are interconnected downhole so that fluid can be circulated in opposite directions. The use of parallel production tubings is expensive and reduces the amount of oil and/or gas that can be produced via the well.

The other available systems require complex equipment which is linked to coiled tubing injectors, or power cable or wireline drums from which tubings, power cables and/or wirelines, that may be up to about 10 km long are reeled up and down via the wellhead during the downhole transport activities.

An example of a known downhole tractor that is connected to a surface power and control unit via an elongate umbilical conduit are disclosed in International patent applications WO 93/18277, WO 91/16520, WO 90/02864 and WO 95/21987.

International patent application WO 98/12418 discloses an autonomous downhole tool which is lowered into a well by means of a base unit that is suspended from an elongate umbilical until the base unit has reached a lower region of the well where the downhole tool is released and propels itself to the toe of the well while it is powered by an onboard battery. The tool can link itself again to the base tool to recharge the battery or to retrieve the assembly to the surface by pulling it up by means of the umbilical.

It is an object of the present invention to provide a method and system for transporting equipment through a conduit, such as an underground well that do not require a complex infrastructure and/or power and control conduits that are reeled up and down via the wellhead or other entrance gate.

It is a further object of the present invention to provide a method and system for transporting equipment through a conduit, such as an underground well which are able to transport and assemble and/or disassemble complex equipment assemblies in the conduit with a minimum of interruption of other operations.

SUMMARY OF THE INVENTION

In accordance with the invention there is provided a method for moving equipment into and through a conduit (which is preferably an underground well), the method comprising:

inserting one or more pieces of equipment into an equipment storage and handling unit which is located at an accessible location (near or above the earth surface in the application to a wellbore), and which comprises an equipment storage rack, a launch conduit and a handling mechanism for moving one or more pieces of equipment from the storage rack into the launch conduit which is in communication with the conduit;

inducing the handling mechanism to insert one or more pieces of equipment into the launch conduit;

releasably connecting each inserted piece of equipment in the launch conduit to a shuttle device which is able to locomote itself through the conduit;

inducing the shuttle device to locomote itself and each piece of equipment connected thereto through the conduit;

releasing each piece of equipment from the shuttle device at a downhole location in the well; and inducing the shuttle device to return to the launch conduit.

Preferably the equipment storage handling unit is equipped with a storage rack formed by a carousel assembly, in which one or more pieces of equipment are stored such that when the carousel assembly is rotated, one stored piece of equipment can be inserted into the launch conduit by the handling mechanism and is then linked to the shuttle device.

It is also preferred that the shuttle device is equipped with at least one wheel and with a battery powered motor which rotates at least one wheel in such a direction relative to a housing of the shuttle device that the wheel rolls along the inner wall of the wellbore and that the shuttle device locomotes itself in a longitudinal direction through the wellbore.

In order to allow the shuttle device to return to the earth surface with minimum energy consumption it may be equipped with a resettable or reusable packer, which is expanded downhole when the shuttle device needs to return to the earth surface, such that the shuttle device and packer provide a seal within a well tubular through which fluids, such as oil and/or gas, are produced and the shuttle device is induced to flow with the stream of well fluids up to the earth surface.

The system according to the invention comprises:

an equipment handling unit which is located near or above the earth surface and which comprises an equipment storage rack, a launch conduit which is in communication with the wellbore and a handling mechanism for moving one or more pieces equipment from the storage rack into the launch conduit; and a shuttle device which is able to locomote itself as a wireless tractor through the launch conduit and the wellbore and which is equipped with a connector to which one or more pieces of equipment can be releasably connected.

The invention also relates to a shuttle device for use in a system for moving equipment through an underground well.

The shuttle device according to the invention comprises a motor which is powered by a power source carried by the device; and at least one wheel or arm which can be pressed against the inner wall of the wellbore and which can be rotated or axially translated by the motor relative to a housing of the shuttle device such that the shuttle device locomotes itself as a wireless tractor throughout the underground well.

Preferably, the shuttle device is equipped with an expandable packer which is in use expanded downhole when the shuttle device needs to move in a downstream direction through the well, such that the packer substantially seals off the wellbore and well fluids produced via the well induce the shuttle device to move in a downstream direction through the wellbore.

It is preferred that the power source carried by the shuttle device is a rechargeable high temperature ceramic lithium ion battery which can be charged and/or recharged by an inductive electric charging device located in a launch tube at the earth surface, and one or more downhole inductive electric charging devices which are located near a packer assembly at the lower end of a production tubing and/or near a downhole garage.

DESCRIPTION OF A PREFERRED EMBODIMENT

Figure 1:
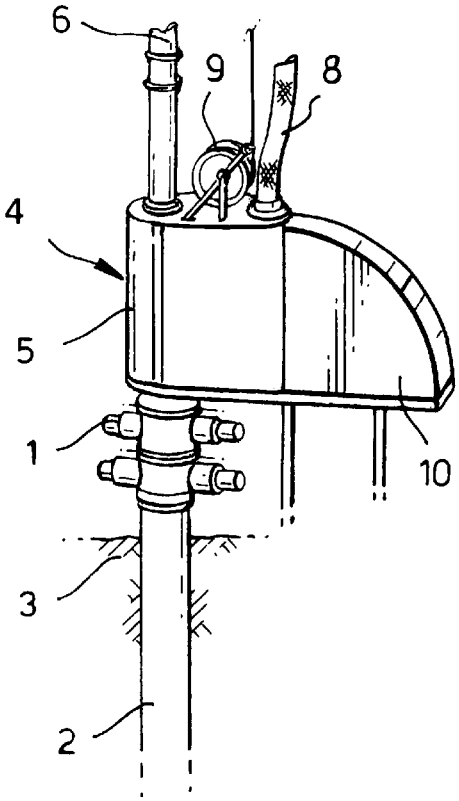
FIG. 1 shows a perspective view of a wellhead which is equipped with an equipment storage and handling unit and with a launch conduit for a shuttle device.

Referring now to FIG. 1 there is shown a wellhead 1 of an oil and/or gas well 2, which penetrates into an underground formation 3.

On the wellhead 1 an equipment storage and handling unit 4 is mounted, which comprises a carousel housing 5 on which a shuttle device launch conduit 6, a flexible equipment dropping ducting 8, a winch 9 for the ducting 8 and an underwater vehicle (AUV) docking and equipment transfer unit 10 are mounted.

Figure 2:
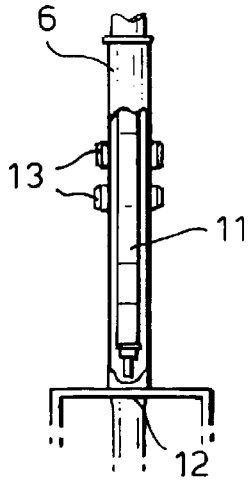
FIG. 2 shows a longitudinal sectional view of the launch table of FIG. 1.

FIG. 2 shows the shuttle device launch conduit 6 in which a shuttle device 11 is located.

The shuttle device 11 rests on a gate 12 which is mounted on top of the carousel housing 5 and electrical power is being supplied to the batteries of the shuttle device 11 via a pair of inductive connectors 13.

Figure 3:
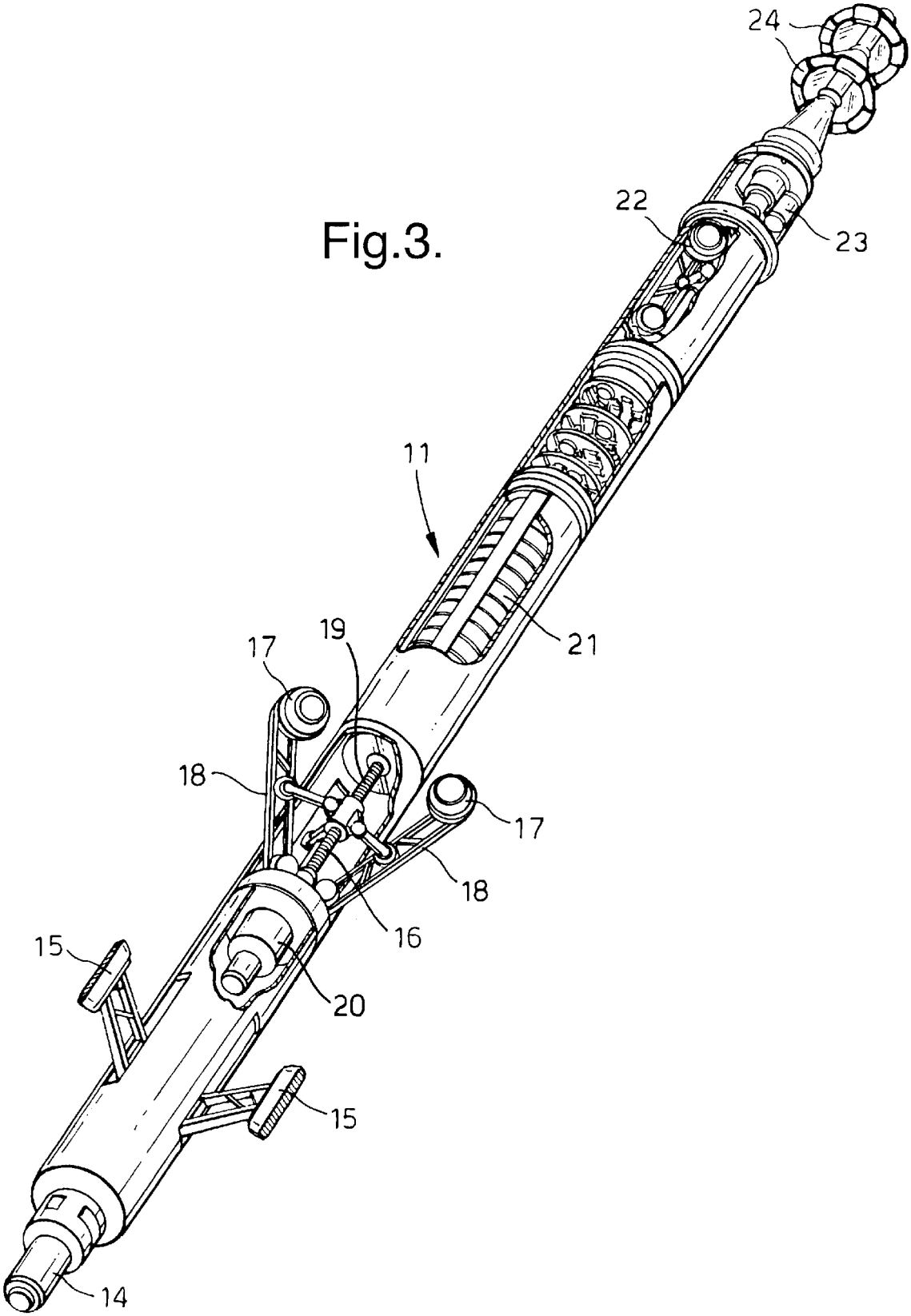
FIG. 3 shows an enlarged perspective, partially cut-away view of the shuttle device of FIG. 2.

FIG. 3 shows in detail the shuttle device 11 of FIG. 2.

The front part of the shuttle device 11 comprises an equipment module connector 14, a set of three articulated bracing feet 15 (two of which are shown), an expandable wheel module unit 16 comprising three wheels 17 (two of which are shown) that are mounted on arms 18 that can be expanded and retracted by a central spindle mechanism 19 which is driven by an electric or other motor 20. The motor 20 and spindle mechanism 19 both expand and retract the arms 18 and drive the wheels 17.

The electric motor 20 and other electric equipment of the shuttle device 11 are powered by Li-ion ceramic or other batteries 21 that are mounted at the center of the device 11.

The rear part of the shuttle device 11 is equipped with an expandable wheel module unit 22 which is similar to the wheel module unit 16 and which is shown in a retracted position, a series of inflatable seals 23 and two articulated Through Flow Line (TFL) umbrella cones 24.

In use the shuttle device 11 is able to descend into the well 2 by gravity. To control the speed of descent the wheels 17 may be expanded against a well tubular and drive the electric motor 20 which then acts as a generator and powers the batteries 21. In a horizontal or upwardly sloping well section the batteries 21 will power the motor 20 and wheel units 16 and 22 and when the shuttle device 11 has reached a downhole location where an equipment module (not shown) is to be released and/or picked up the module connector 14 is activated to release a module and if another module is to be picked up the shuttle device 11 is moved towards that module whereupon the connector 14 is activated to connect it to the shuttle device 11. The seals 23 and/or TFL umbrella cones 24 are then expanded so that the shuttle device returns as a kind of TFL device activated by the flow of oil and/or gas back to the wellhead 1.

During the return voyage the wheel units 16 and 22 may either be retracted or expanded to provide power to the batteries and/or to power the wheel units 16 and 22 in areas where the movement of the shuttle device 11 is hampered.

Figure 4:
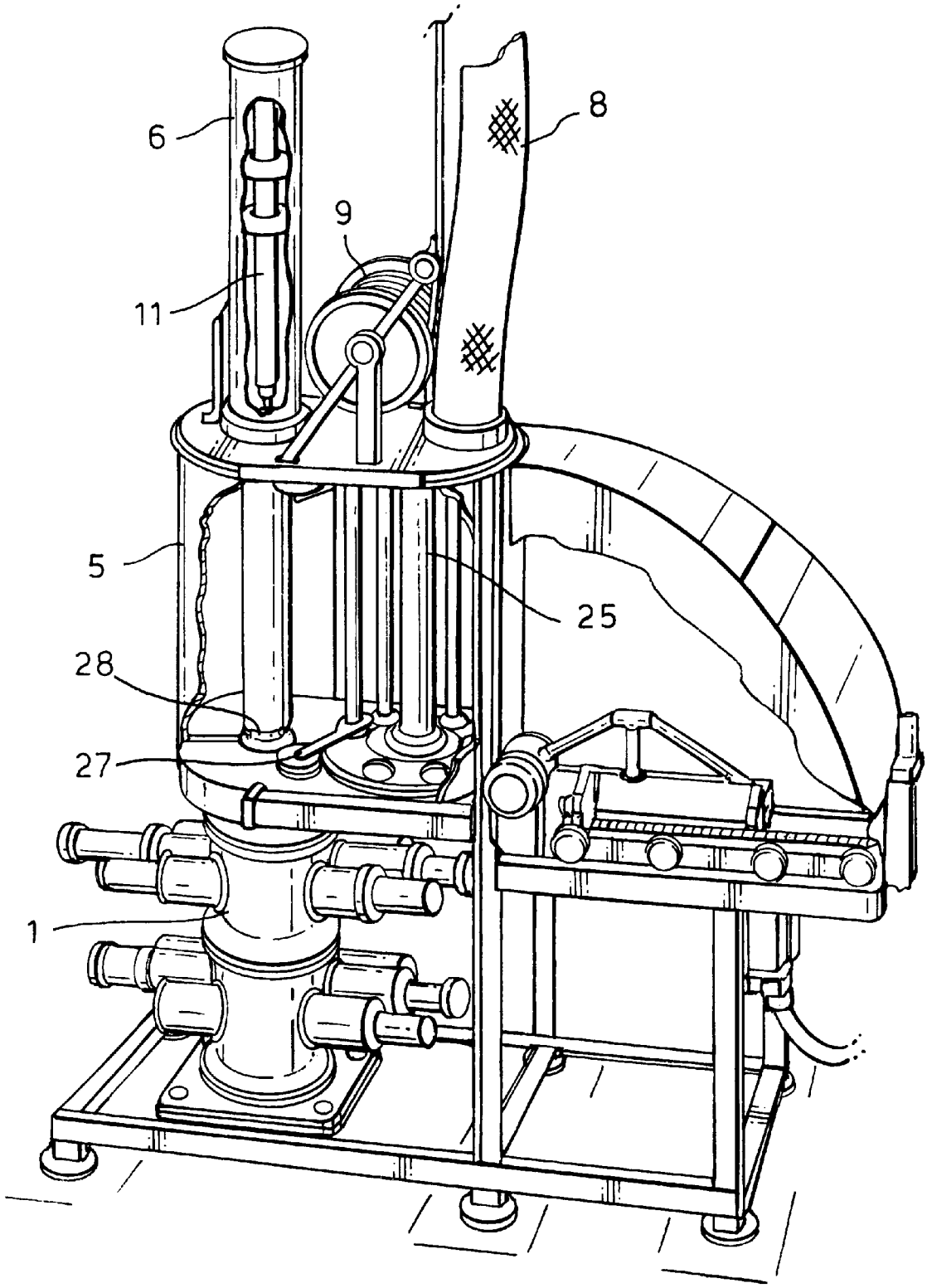
FIG. 4 shows an enlarged perspective, partially cut-away view of the wellhead, launch tube and equipment handling unit of FIG. 1.

FIG. 4 shows in detail how the equipment handling and storage unit 4 and the launch conduit 6 are arranged on the wellhead 1. The carousel housing 5 of the unit comprises a carousel 25 in which one or more equipment modules 26 are stored and a loading mechanism 27 which is able to transfer an equipment module 26 from the carousel into the launch tube 6, if the launch tube 6 is half-open within the carousel housing 5. After retrieval of the loading mechanism 27 the launch tube 6 is closed again, the gate 12 is opened and the shuttle device 11 is connected to the equipment module within the launch tube 6, whereupon the gate 28 at the bottom of the carousel housing 5 is opened and the shuttle device 11 is released via the wellhead 1 into the well 2.

Figure 5:
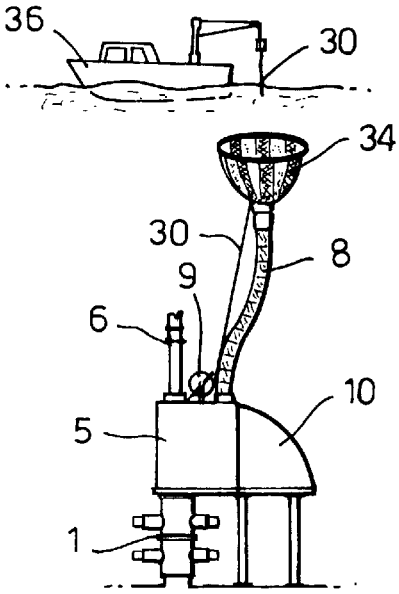
FIG. 5 shows a condensed side view of the unit of FIGS. 1 and 4 in a subsea well which is equipped with a guide funnel and flexible ducting for dropping equipment into the storage and handling unit.

FIG. 5 shows how the flexible ducting 8 can be stretched towards the water surface 30 by winching out a cable 31 by means of the winch 9, if the wellhead 1 is located at the bottom 32 of a body of water 33.

Figure 6:
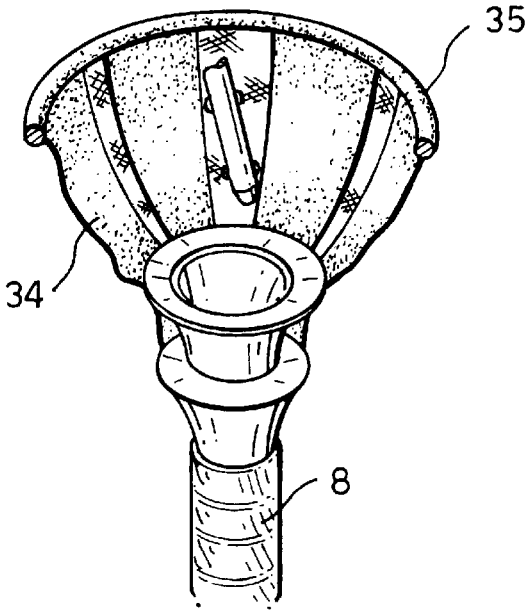
FIG. 6 shows in detail the plastic netting guide funnel at the top of the flexible ducting of FIG. 5.

A plastic netting funnel 34 which is equipped with a buoyancy ring 35 as shown in detail in FIG. 6 is thereby winched towards the water surface 30 so that an equipment module can be dropped into the funnel 34 from a vessel 36. The thus dropped module will slide through the flexible ducting 8 into the carousel housing 5 and into the carousel 25.

Figure 7:
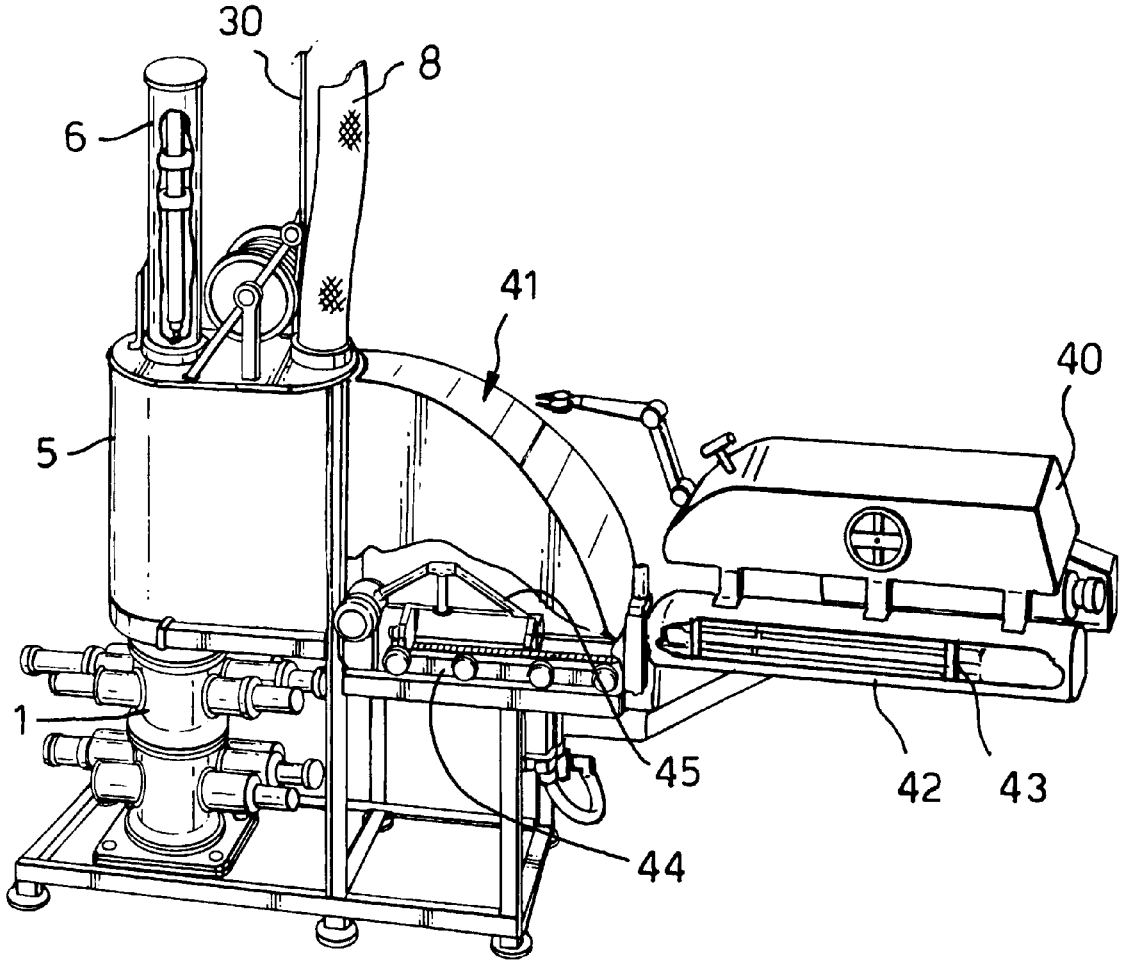
FIG. 7 shows a perspective, partially cut-away view of the unit of FIGS. 1, 4 and 5 where an automated or teleoperated underwater vehicle (AUV) is linked to an equipment transfer section of the carousel housing.

FIG. 7 shows how an Autonomous or Teleoperated Underwater Vehicle (AUV) 40 is linked to an equipment transfer section 41 of the carousel housing 5. The AUV comprises an equipment module carrier 42 which is able to insert and/or remove equipment modules 43 into and/or from the transfer section 41. The transfer section comprises a module conveyor 44 and module gripping arm 45 for transferring equipment modules between the conveyor 44 and carousel 25.

Figure 8:
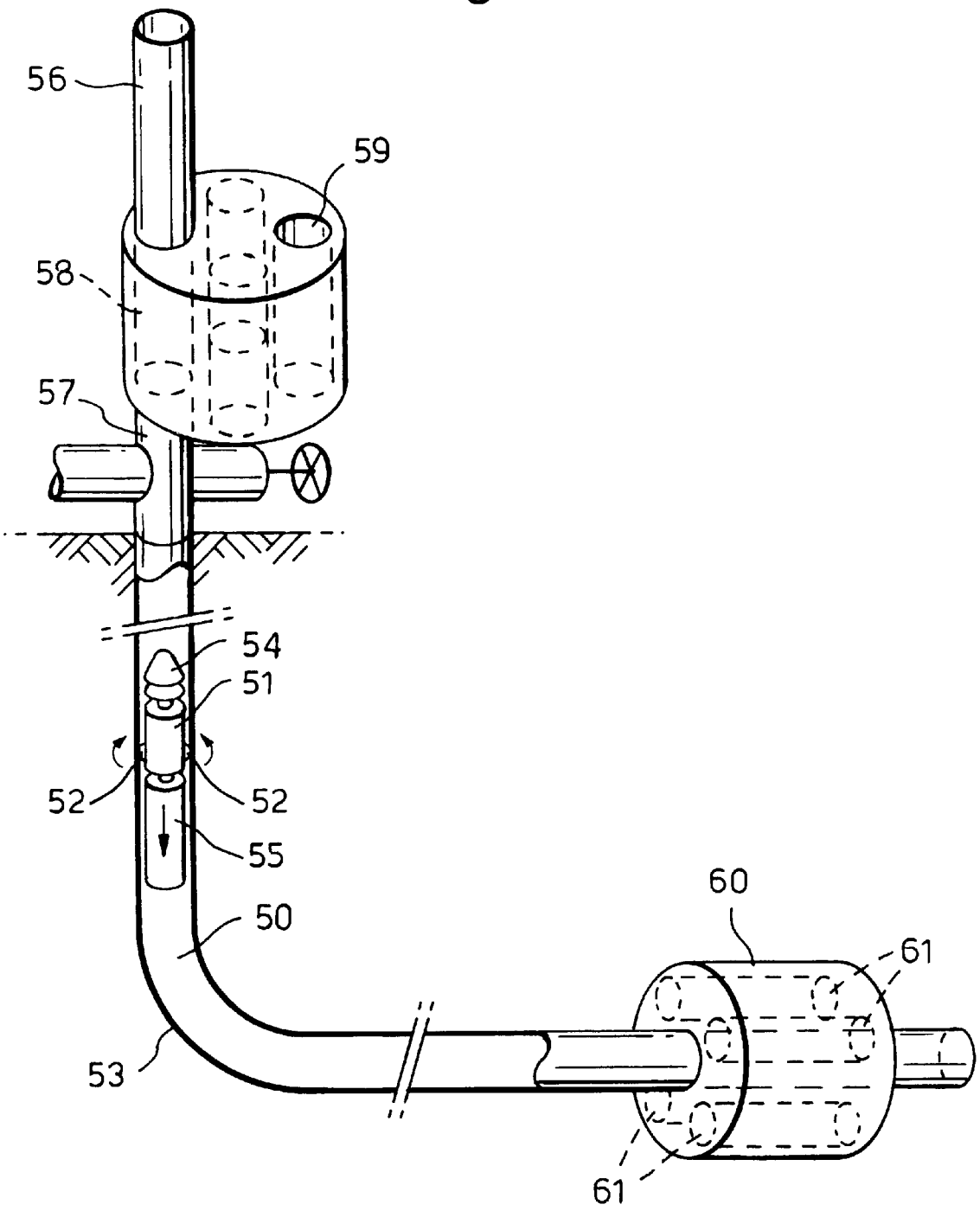
FIG. 8 shows an alternative embodiment of a well system according to the invention in which a shuttle device transfers equipment modules between a wellhead carousel and a downhole garage.

It will be understood that the shuttle device launch conduit 6 may be located underneath the carousel housing 5 and that the well may be equipped with a downhole equipment garage which is shown in FIG. 8.

FIG. 8 shows a well 50 through which a shuttle device 51 moves in downward direction. The shuttle device 51 is equipped with two wheels 52 that roll on the inner surface of a well tubular 53 and a pair of articulated TFL-umbrella cones 54 and carries an equipment module 55. The TFL-umbrella is preferred for use in larger-diameter applications, and the cylindrical TFL seal is preferred for smaller pipe sections. This enables one tool with two seal fittings to be used for a wide range of applications. Providing alternative seal arrangements rather than one seal to fit a wide range of applications is preferred.

The shuttle device 51 has been launched from a launch conduit 56 which is connected to the wellhead 57 and well tubular 53 via a carousel housing 58 into which equipment modules can be inserted via an entrance gate 59. The shuttle device 51 moves towards a downhole equipment garage 60 which comprises a carousel in which four or more equipment modules 61 can be stored. Transfer of equipment modules between the carousel and shuttle device 51 is accomplished either by rotating the carousel or by a robotic arm which is mounted either on the shuttle device 51 or on the garage 60.

The shuttle device 51 may be equipped with a fuel cell and/or with a rechargeable battery (not shown) which is recharged at the downhole equipment garage 60 by means of an inductive power coil (not shown) which is arranged within or adjacent to the garage. A suitable rechargeable battery is a high-temperature ceramic lithium ion battery which is disclosed in International patent application WO 97/10620.

Alternatively the shuttle device 51 may be recharged by means of an inductive power coil which is located at or near a packer at the lower end of a production tubing (not shown). In that case the inductive power coil may be combined with the packer into a single assembly which can be installed and retrieved together with the production tubing. The inductive power coil could also be used for transmission of electric signals to and from the shuttle device so that data gathered by, and stored in a memory of, the shuttle device are transmitted to the surface via a power and/or signal cable extending through the annular space surrounding the production tubing.

What is claimed is:

1. A method for moving equipment into and through a conduit, the method comprising:

inserting one or more pieces of equipment into an equipment storage and handling unit which is located near an accessible point of the conduit and which comprises an equipment storage rack, a launch conduit and a handling mechanism for moving the one or more pieces of equipment from the storage rack into the launch conduit which is in communication with the conduit;

inducing the handling mechanism to insert the one or more pieces of equipment into the launch conduit;

releasably connecting each inserted piece of equipment in the launch conduit to a shuttle device which is able to locomote itself through the conduit;

inducing the shuttle device to locomote itself and each piece of equipment connected thereto through the conduit;

releasing each piece of equipment from the shuttle device at a downhole location in the conduit; and inducing the shuttle device to return to the launch conduit.

2. The method of claim 1, wherein the equipment storage and handling unit is equipped with the storage rack formed by a carousel assembly, in which the one or more pieces of equipment are stored such that when the carousel assembly is rotated, one stored piece of equipment can be inserted into the launch conduit by the handling mechanism and is then linked to the shuttle device.

3. The method of claim 1, wherein the shuttle device is equipped with at least one wheel and with a battery powered motor which rotates at least one wheel in such a direction relative to a housing of the shuttle device that the wheel rolls along the inner wall of the conduit and that the shuttle device locomotes itself in a longitudinal direction through the conduit.

4. The method of claim 3, wherein the shuttle device is equipped with an expandable packer, which is expanded in the conduit when the shuttle device needs to return to the launch conduit, such that the shuttle device and packer provide a seal within the conduit through which fluids flow and the shuttle device is induced to flow with the stream of fluids up to an entrance gate.

5. A system for moving equipment into and through a conduit, the system comprising:

an equipment handling unit which is located near an accessible point in the conduit and which comprises an equipment storage rack, a launch conduit which is in communication with the conduit and a handling mechanism for moving one or more pieces equipment from the storage rack into the launch conduit; and a shuttle device which is able to locomote itself as a wireless tractor through the launch conduit and the conduit and which is equipped with a connector to which said one or more pieces of equipment can be releasably connected.

6. The system of claim 5, wherein the equipment handling unit is equipped with the storage rack formed by a carousel assembly in which said one or more pieces of equipment are stored such that when the carousel assembly is rotated, one stored piece of equipment can be inserted into the launch conduit by the handling mechanism and is then linked to the shuttle device.

7. The system of claim 5, wherein the shuttle device is equipped with at least one wheel and with a battery powered motor which rotates at least one wheel in such a direction relative to a housing of the shuttle device that the wheel rolls along the inner wall of the conduit and that the shuttle device locomotes itself in a longitudinal direction through the conduit.

8. The system of claim 7 wherein the conduit is a wellbore and the accessible location is at or near the surface of the earth.

9. The system of claim 8, wherein the shuttle device is equipped with an expandable packer, which is expanded in the conduit when the shuttle device is to be returned to the earth surface, such that the packer provides a seal within the wellbore through which well fluids are produced and the shuttle device is induced to flow with the stream of well fluids up to the earth surface.

10. The system of claim 8, wherein the well is equipped with a downhole garage in which a plurality of equipment modules can be stored.

11. The system of claim 10, wherein the downhole garage is equipped with a carousel in which equipment modules can be inserted by the shuttle device.

* * * * *